US010537162B2

(12) United States Patent
Yeung

(10) Patent No.: US 10,537,162 B2
(45) Date of Patent: Jan. 21, 2020

(54) HAIR STYLING DEVICE

(71) Applicant: KONINKLIJKE PHILIPS N.V., Eindhoven (NL)

(72) Inventor: Ki Cheong Yeung, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 438 days.

(21) Appl. No.: 15/328,078

(22) PCT Filed: Jul. 30, 2015

(86) PCT No.: PCT/EP2015/067449
§ 371 (c)(1),
(2) Date: Jan. 23, 2017

(87) PCT Pub. No.: WO2016/016349
PCT Pub. Date: Feb. 4, 2016

(65) Prior Publication Data

US 2017/0215541 A1 Aug. 3, 2017

(30) Foreign Application Priority Data

Aug. 1, 2014 (CN) ..... 2014 2 0433049 U
May 27, 2015 (CN) ..... 2015 1 0278913

(51) Int. Cl.
*A45D 6/02* (2006.01)
*A45D 2/02* (2006.01)
*A45D 2/36* (2006.01)

(52) U.S. Cl.
CPC ..... *A45D 2/02* (2013.01); *A45D 2/36* (2013.01); *A45D 6/02* (2013.01)

(58) Field of Classification Search
CPC ... A45D 2/02; A45D 2/36; A45D 6/02; A45D 1/16; A45D 2/00; A45D 2/10; A45D 2/08; A45D 2006/005; A45D 6/04; A45D 7/02
See application file for complete search history.

(56) References Cited

U.S. PATENT DOCUMENTS 2,935,070 A 5/1960 Auz
3,618,620 A * 11/1971 Williams ..... A45D 2/10 132/212
3,835,292 A * 9/1974 Walter ..... A45D 1/04 219/222
3,934,114 A * 1/1976 Godel ..... A45D 1/04 219/222

(Continued)

FOREIGN PATENT DOCUMENTS

CN 103565076 2/2014
CN 203692796 7/2017

*Primary Examiner* — Nicholas D Lucchesi

(57) ABSTRACT

The present invention discloses a hair styling device (10, 20) comprising an inner cylindrical shell (121, 221) provided with through-holes; a rotatable cylindrical shell (122, 222) surrounding the inner cylindrical shell (121, 221); a drive assembly (123, 223) for driving the rotatable cylindrical shell (122, 222) to rotate around the inner cylindrical shell (121, 221) for winding hair around the inner cylindrical shell (121, 221); and a wind supply assembly (130, 230) for supplying hot air to any hair wound around the inner cylindrical shell (121, 221) through the through-holes. According to the present invention, hot air is supplied to the hair wound around the inner cylindrical shell (121, 221) so that the hair is heated evenly and shaped.

20 Claims, 13 Drawing Sheets

(56) References Cited

U.S. PATENT DOCUMENTS

| | | | | | |
|---|---|---|---|---|---|
| 4,009,367 | A * | 2/1977 | Rizzuto | A45D 1/04 | 132/232 |
| 4,148,330 | A * | 4/1979 | Gnaga | A45D 6/02 | 132/238 |
| 4,177,824 | A | 12/1979 | Gnaga | | |
| 4,222,398 | A * | 9/1980 | Fromman | A45D 6/04 | 132/238 |
| 4,829,156 | A * | 5/1989 | Thompson | A45D 1/04 | 132/232 |
| 5,626,156 | A * | 5/1997 | Vicory, Sr. | A45D 2/10 | 132/229 |
| 5,649,555 | A * | 7/1997 | Harris | A45D 1/04 | 132/232 |
| 6,962,159 | B1 * | 11/2005 | Adam | A45D 6/02 | 132/210 |
| 7,513,259 | B2 * | 4/2009 | Kimata | A45D 2/10 | 132/245 |
| 8,607,804 | B2 * | 12/2013 | De Benedictis | A45D 2/02 | 132/237 |
| 8,651,118 | B2 * | 2/2014 | De Benedictis | A45D 2/02 | 132/238 |
| 8,733,374 | B2 * | 5/2014 | De Benedictis | A45D 2/02 | 132/238 |
| 8,869,808 | B2 | 10/2014 | De Benedictis | | |
| 9,027,570 | B2 * | 5/2015 | De Benedictis | A45D 2/02 | 132/238 |
| 9,185,957 | B2 * | 11/2015 | Richmond | A45D 2/36 | |
| 9,198,493 | B2 * | 12/2015 | Hall | B26B 19/00 | |
| 9,615,643 | B2 * | 4/2017 | De Benedictis | A45D 2/02 | |
| 9,615,644 | B2 * | 4/2017 | De Benedictis | A45D 2/02 | |
| 9,629,434 | B2 * | 4/2017 | DeBenedictis | A45D 2/02 | |
| 9,788,625 | B2 * | 10/2017 | De Benedictis | A45D 2/02 | |
| 9,854,891 | B2 * | 1/2018 | De Benedictis | A45D 2/02 | |
| 10,238,196 | B2 * | 3/2019 | DeBenedictis | A45D 2/02 | |
| 2008/0236610 | A1 | 10/2008 | Bartels | | |
| 2014/0083446 | A1 | 3/2014 | Julemont | | |

* cited by examiner

HAIR STYLING DEVICE

This application is the U.S. National Phase application under 35 U.S.C. § 371 of International Application No. PCT/EP2015/067449, filed on Jul. 30, 2015, which claims the benefit of International Application No. 201420433049.1 filed on Aug. 1, 2014 and International Application No. 201510278913.4 filed on May 27, 2015. These applications are hereby incorporated by reference herein.

FIELD OF THE INVENTION

The present invention relates to a hair styling device.

BACKGROUND OF THE INVENTION

With the development of society and the improvement of living standard, the aesthetical standard of people is also increasing. Personality and fashion become trendy things in terms of beauty. The hair can be styled in different ways to add to people's beauty. At present, curly hair achieved by means of a hair styling device is one of the most popular hairstyles.

In the case of a traditional hair styling device, the hair generally needs to be wound on a heated metal bar so as to make it curl by means of the high temperature of the metal bar. For example, as disclosed in Chinese patent publication number CN102783803, a curling iron includes a main body, an aluminum tube and other elements, and it further includes a heating element disposed inside the aluminum tube and a first aluminum spring and a second aluminum spring, both of which are disposed on the aluminum tube. When curling hair by using this curling iron, the hair is positioned between the first aluminum spring and the second aluminum spring and then the hair is heated by means of heat conduction, and finally the design will be finalized. Although the curling iron can be used to achieve curly hair, it has the following drawbacks: due to exposure to the heat-conducting aluminum tube and springs thereof, the skin of users could easily get burned during use of the curling iron, especially when the users use it to treat their own hair; and by the use of the heating element in such a way that it operates through heat conduction from the inside out, the hair wound around the aluminum tube first and the hair wound last have different temperatures, as a result of which the innermost hair may easily be damaged due to high temperatures and then lose its luster, and the outer hair cannot easily be shaped. Thus, the styling result is not of the desired quality and looks unnatural.

In view of this, it is necessary to provide a hair styling device producing a good hair curling effect and having better safety characteristics so as to solve the aforementioned technical matters.

SUMMARY OF THE INVENTION

An object of the present invention is to overcome the drawbacks of the prior art by providing a hair styling device which produces a good curling effect and which has better safety characteristics. The invention is defined by the independent claims; the dependent claims define advantageous embodiments.

To achieve the above object, there is provided a hair styling device, which includes a housing comprising a handle and a top casing connected to a top of the handle, the top casing having a hair inlet formed thereon and an air outlet formed at a top thereof, and the handle having an air inlet formed at a bottom thereof; a curling assembly disposed inside the housing, the curling assembly comprising an inner cylindrical shell fixed inside the top casing and provided with through-holes formed therein, a rotatable cylindrical shell surrounding the inner cylindrical shell and a drive assembly connected with the rotatable cylindrical shell for driving the rotatable cylindrical shell to rotate around the inner cylindrical shell so as to make the hair passing through the hair inlet be wound around the inner cylindrical shell; a wind supply assembly disposed inside the housing for supplying hot wind and cool wind to the hair in the top casing; and a control assembly connected with the drive assembly and the wind supply assembly for controlling an operating state of the hair styling device.

In one aspect of the invention, a wind shield is provided above the air outlet for guiding the hot wind/cool wind toward two sides of the wind shield.

In one aspect of the invention, the top of the inner cylindrical shell is fixed on a top central area of the top casing, around which the air outlet is disposed.

In one aspect of the invention, the air outlet is a cambered hole; and the wind shield is a corresponding cambered plate for guiding the hot wind/cool wind toward an inside edge and an outside edge of the cambered plate.

In one aspect of the invention, an air guiding element is disposed at a bottom of the inner cylindrical shell, the air guiding element comprising a top opening fixed at the bottom of the inner cylindrical shell and a bottom opening with a diameter bigger than that of the top opening and facing towards an outlet of a wind channel of the handle directly.

In one aspect of the invention, the rotatable cylindrical shell has at least an upward notch formed thereon and at least a hooked structure formed at a side of the upward notch and bending towards the upward notch.

In one aspect of the invention, the rotatable cylindrical shell has two upward notches and two hooked structures, the two hooked structures bending in opposite direction and towards a corresponding upward notch, respectively.

In one aspect of the invention, at least an elastic strip made of heat resisting elastic material is disposed on an inner wall of the rotatable cylindrical shell along a longitudinal direction thereof and extends towards the inner cylindrical shell for applying pressure onto the hair wound around the inner cylindrical shell.

In one aspect of the invention, three elastic strips are uniformly disposed on the inner wall of the rotatable cylindrical shell.

In one aspect of the invention, a circular flange is formed on an outside surface of a lower portion of the rotatable cylindrical shell; and the lower portion of the rotatable cylindrical shell is installed at the bottom of the top casing and is rotatable relative to the top casing by means of a ring part cooperating with the circular flange.

In one aspect of the invention, the top casing comprises an upper body and a lower body, and at least a locking element is provided at a bottom edge of the upper body and at least a corresponding groove is provided at a top edge of the lower body, the upper body and the lower body being assembled together by means of cooperation of the locking element and the groove.

In one aspect of the invention, a release button made of thermal insulation material is disposed on an outer surface of the locking element; and when pressing the release button, the locking element is capable of being released from the groove.

In one aspect of the invention, the upper body has a first notch formed on a side surface of the upper body and extending to a top surface of the upper body; the lower body has a second notch formed on a side surface thereof; and when the upper body and the lower body are assembled together, the first notch and the second notch form a long and narrow hair inlet together.

In one aspect of the invention, a circular connecting element is provided for connecting the top casing and the handle; a top of the circular connecting element is installed onto the bottom of the lower body; a number of locating notches are uniformly provided at a bottom of the circular connecting element and a number of corresponding locating protrusions are provided at the top of the handle; by means of cooperation of the locating notches and the locating protrusions, there are a number of installation locations provided between the top casing and the handle.

In one aspect of the invention, a number of bumps, each of which corresponds to one of the locating notches, are provided on outer surface of the bottom of the lower body.

In one aspect of the invention, the top casing is made of thermal insulation material; or the inner wall of the top casing is covered by a heat insulating layer made of thermal insulation material.

In one aspect of the invention, the drive assembly comprises a rotatable ring provided with an inner toothed surface, a gear engaging the inner toothed surface of the rotatable ring and a first motor provided for driving the gear, the rotatable cylindrical shell being installed onto the rotatable ring, and the first motor being connected with and controlled by the control assembly. Alternatively, the drive assembly comprises a rotatable ring, a shaft, and a motor, the rotatable ring being connected to the motor via the shaft and driven by the motor, the rotatable cylindrical shell being installed onto the rotatable ring, and the motor being connected with and controlled by the control assembly.

In one aspect of the invention, the wind supply assembly comprises a wind channel, a heating element disposed inside the wind channel, fan blades disposed at a lower end of the wind channel and a second motor provided for driving the fan blades; the wind channel has an upper end facing towards a lower end of the rotatable cylindrical shell directly, the fan blades facing towards the air inlet formed at the bottom of the handle directly, and both the heating element and the second motor being connected with and controlled by the control assembly.

In one aspect of the invention, the control assembly comprises a number of control buttons, all of which are exposed on the surface of the handle, the control buttons comprising a left-hand/right-hand rotation button, a cool wind button and a wind speed/switch button.

In one aspect of the invention, the hair styling device further comprises a hair care assembly which comprises a holder installed in the top casing and a water absorbent element fixed on the holder and disposed inside the inner cylindrical shell by passing through a through hole formed at the top of the top casing.

Compared with the prior art, the present invention has a number of advantages, such as: when curling hair by using the hair styling device of the present invention, the hair can be wound around the inner cylindrical shell and at this stage, hot wind will be supplied to the hair wound around the heat-conducting cylindrical shell so that the hair will be heated evenly and then shaped finally. As a result, it causes less damage to the hair and the hair looks more natural. Additionally, because the inner cylindrical shell is disposed inside the housing, the skin of users will not be burned, and thus it has better safety characteristics.

A better understanding of the present invention will be obtained from the following detailed description by combining the accompanying drawings, which are used to illustrate embodiments of the present invention.

DETAILED DESCRIPTION OF ILLUSTRATED EMBODIMENTS

Figure 1:
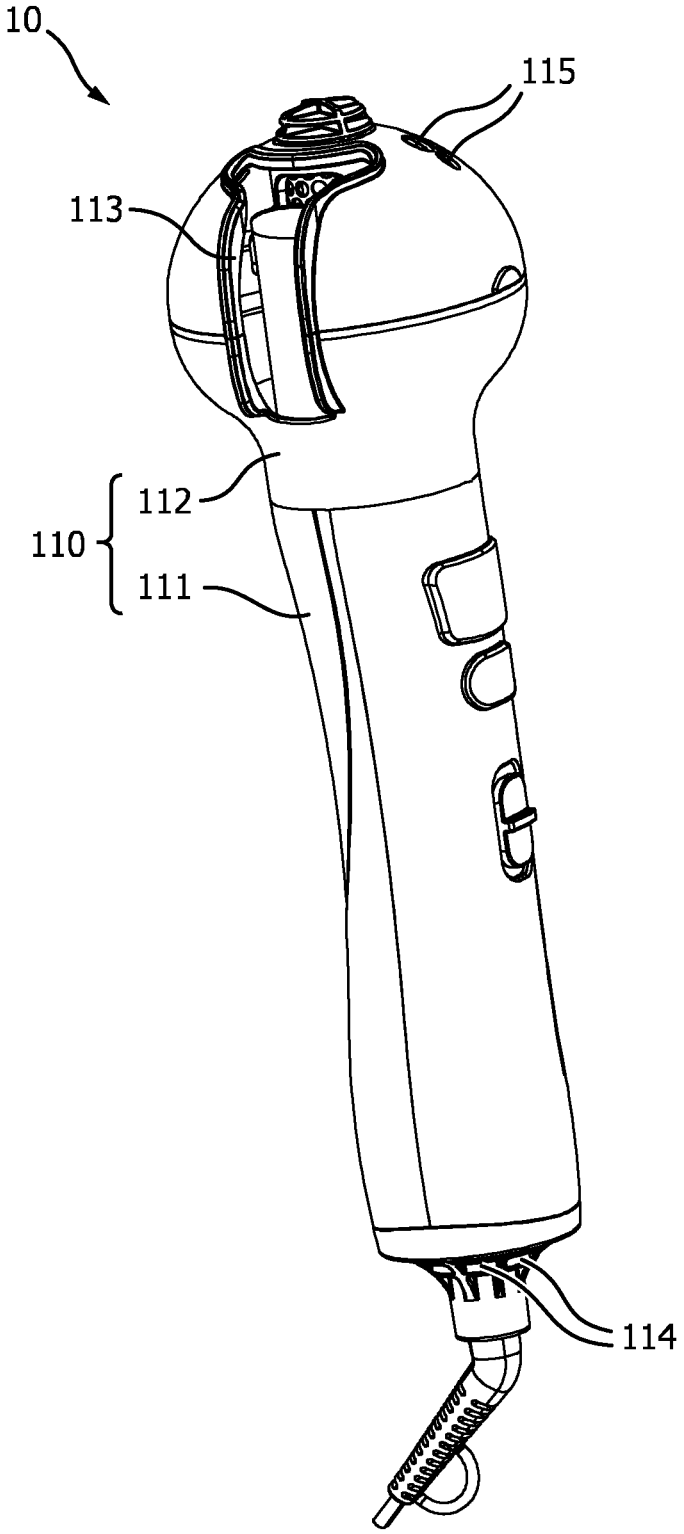
FIG. 1 is a perspective view of a hair styling device according to a first embodiment of the present invention.

The technical solutions of the embodiments will be clearly and completely described hereinbelow by combining the figures of the embodiments of the present invention, and similar reference numbers in the figures represent similar components. Based on the embodiments of the present invention, other embodiments could be created by one of ordinary skill in the art without creative work, and all such embodiments fall within the extent of protection of the present invention.

FIG. 1 to FIG. 6 illustrate a hair styling device according to a first embodiment of the present invention. Referring to FIG. 1 to FIG. 6, in this embodiment, the hair styling device 10 includes a housing 110, a curling assembly 120, a wind supply assembly 130 and a control assembly 140. All of the curling assembly 120, wind supply assembly 130 and control assembly 140 are disposed inside the housing 110. The curling assembly 120 is provided for curling the hair in the housing 110, the wind supply assembly 130 is provided for supplying wind power (cool wind or hot wind) to the hair in the housing 110 and the control assembly 140 is provided for controlling the operating state of the whole hair styling device 10.

Figure 2:
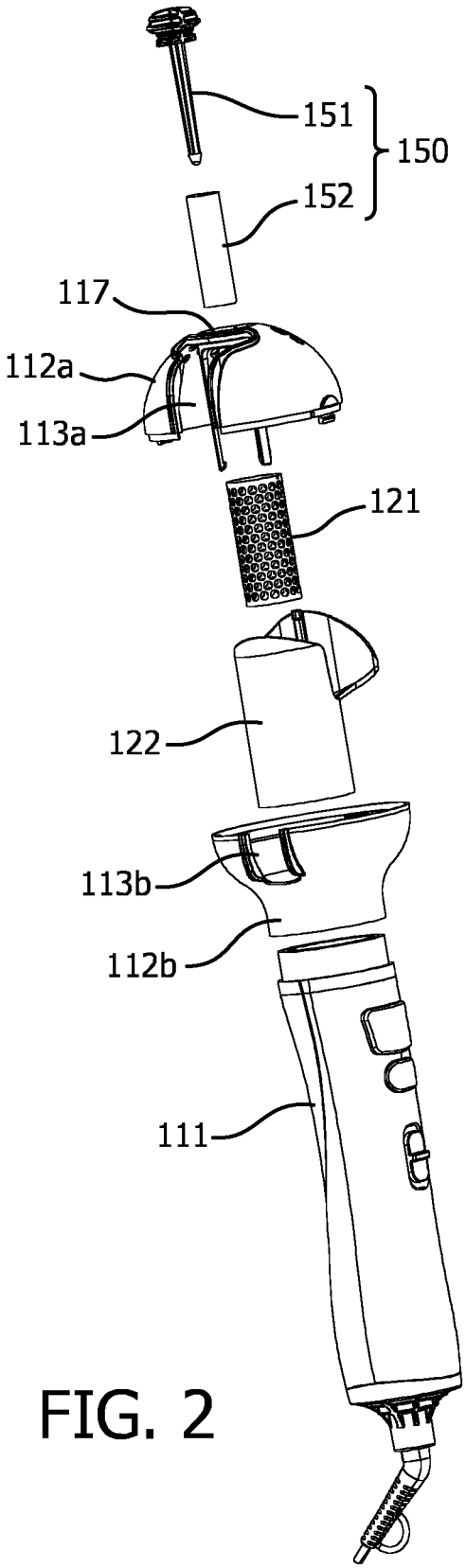
FIG. 2 is an exploded view of the hair styling device shown in FIG. 1.
Figure 3:
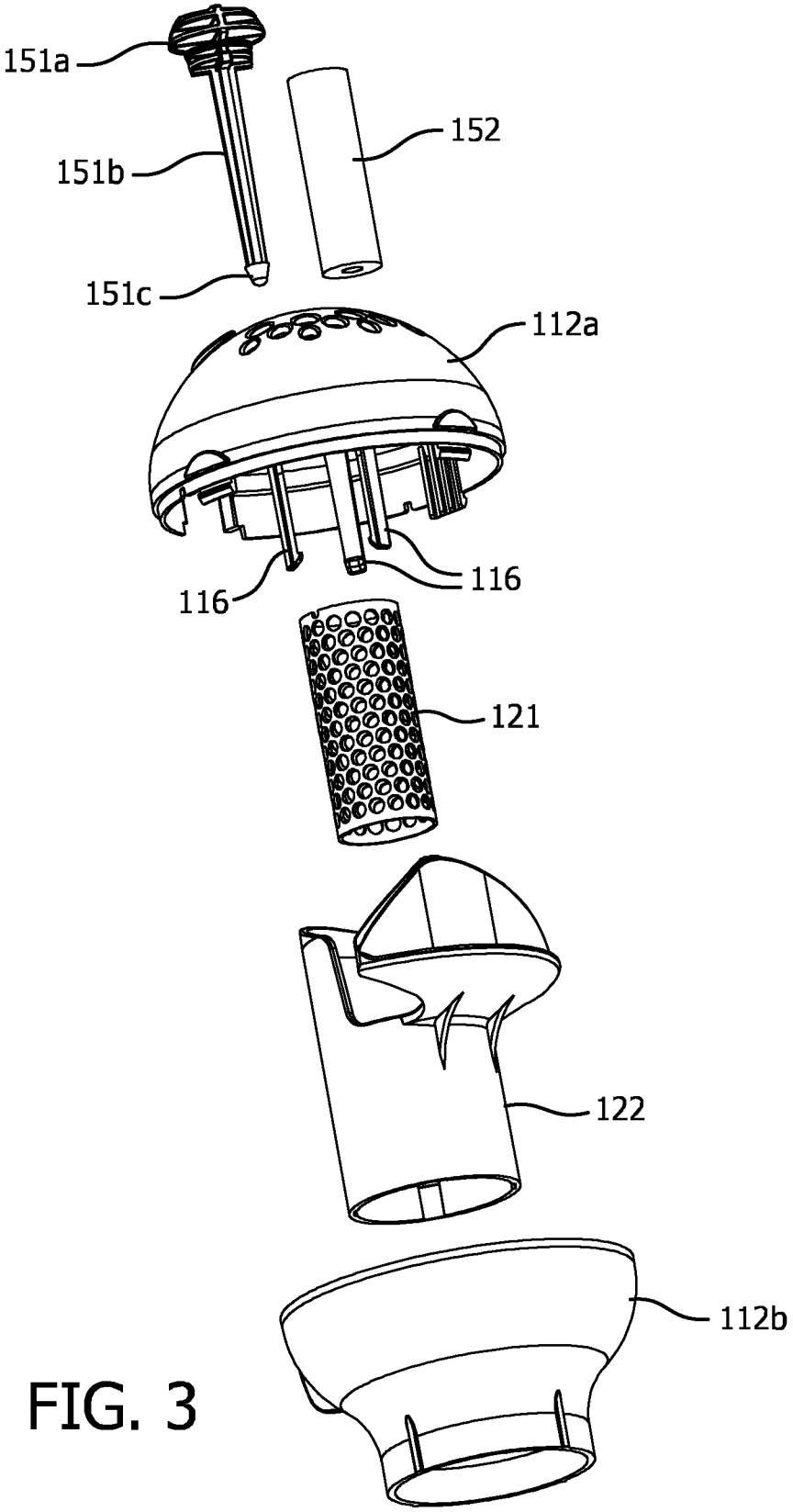
FIG. 3 is a partially exploded view of the hair styling device shown in FIG. 1.

Referring to FIG. 1 to FIG. 3, the housing 110 of this embodiment includes a handle 111 and a top casing 112 installed on the top of the handle 111. A hair inlet 113 is formed on the top casing 112. An air inlet 114 is formed at the bottom of the handle 111 and an air outlet 115 is formed at the top of the top casing 112. In some embodiments, such as in this embodiment, the top casing 112 has a generally globular external profile and the top casing 112 includes an upper body 112*a* and a lower body 112*b*, both of which are assembled together. The upper body 112*a* has a first notch 113*a* formed thereon and the lower body 112*b* has a second notch 113*b* formed thereon. When the upper body 112*a* and the lower body 112*b* are assembled together, the first notch 113*a* and the second notch 113*b* together form the hair inlet 113. Due to a separate structure, such that the housing is mainly composed of the upper body 112*a*, lower body 112*b* and a handle 111, the installation of the assembly units in the top casing 112 is facilitated.

Referring to FIG. 2 to FIG. 5, the curling assembly 120 of this embodiment includes an inner cylindrical shell 121 fixed inside the top casing 112 and provided with through-holes formed therein, a rotatable cylindrical shell 122 surrounding the inner cylindrical shell 121 and a drive assembly 123 connected with the rotatable cylindrical shell 122 for driving the rotatable cylindrical shell 122 to rotate around the inner cylindrical shell 121 so as to make the hair passing through the hair inlet 113 be wound around the inner cylindrical shell 121.

Referring to FIG. 3, in some embodiments, for example in this embodiment, for easy installation of the inner cylindrical shell 121, a number of elastic legs 116 are provided inside the upper body 112*a* of the top casing 112 and extending downward. In this embodiment, the number of elastic legs 116 is three and each of the elastic legs 116 has a hook-like claw formed at the tail end thereof. In the installation process, the inner cylindrical shell 121 can be pushed into a space formed by the elastic legs 116 and positioned inside the space by the hook-like claws. It is understood that the inner cylindrical shell 121 having the through-holes suffices to allow hot air to pass through; however, to achieve a better effect, in this embodiment, the inner cylindrical shell 121 is preferred to be a heat-conducting cylindrical shell. Hereinafter, the heat-conducting cylindrical shell is indicated with the same reference sign as the inner cylindrical shell. The heat-conducting cylindrical shell 121 comprises a tubular structure made of metal, so that the heat-conducting cylindrical shell 121 has good thermal conductivity. Additionally, the tubular structure has a number of through-holes formed therein, so that the hot wind can permeate the hair wound around the heat-conducting cylindrical shell 121.

Figure 4:
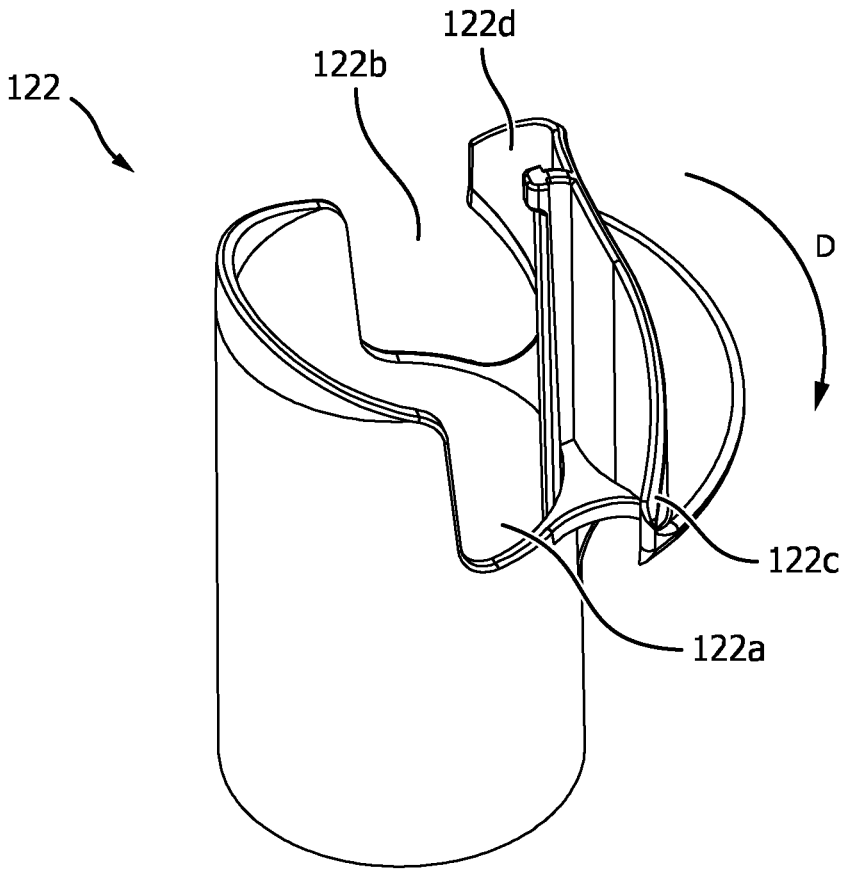
FIG. 4 is a perspective view of a rotatable cylindrical shell of the hair styling device shown in FIG. 1.

Referring to FIG. 4, in some embodiments, for example in this embodiment, the rotatable cylindrical shell 122 has two upward notches 122*a*, 122*b* and two hooked structures 122*c*, 122*d*. The two hooked structures 122*c*, 122*d* are formed by an integrated structure and they bend towards corresponding upward notches 122*a*, 122*b*, respectively, in opposite direction. As shown in FIG. 4, the hooked structure 122*c* bends in the direction of arrowhead D, that is, it bends in a clockwise direction seen in top view; and the hooked structure 122*d* bends in the opposite direction, that is, it bends in anti-clockwise direction seen in top view. When the rotatable cylindrical shell 122 rotates in clockwise direction, the hair can be caught by the hooked structure 122*c* and wound around the heat-conducting cylindrical shell 121 in clockwise direction; and when the rotatable cylindrical shell 122 rotates in anti-clockwise direction, the hair can be caught by the hooked structure 122*d* and wound around the heat-conducting cylindrical shell 121 in anti-clockwise direction. Understandably, if it just needs to curl the hair in one direction (clockwise direction or anti-clockwise direction) according to actual needs, the rotatable cylindrical shell 122 also can be designed to have only one upper notch and one corresponding hooked structure.

Figure 5:
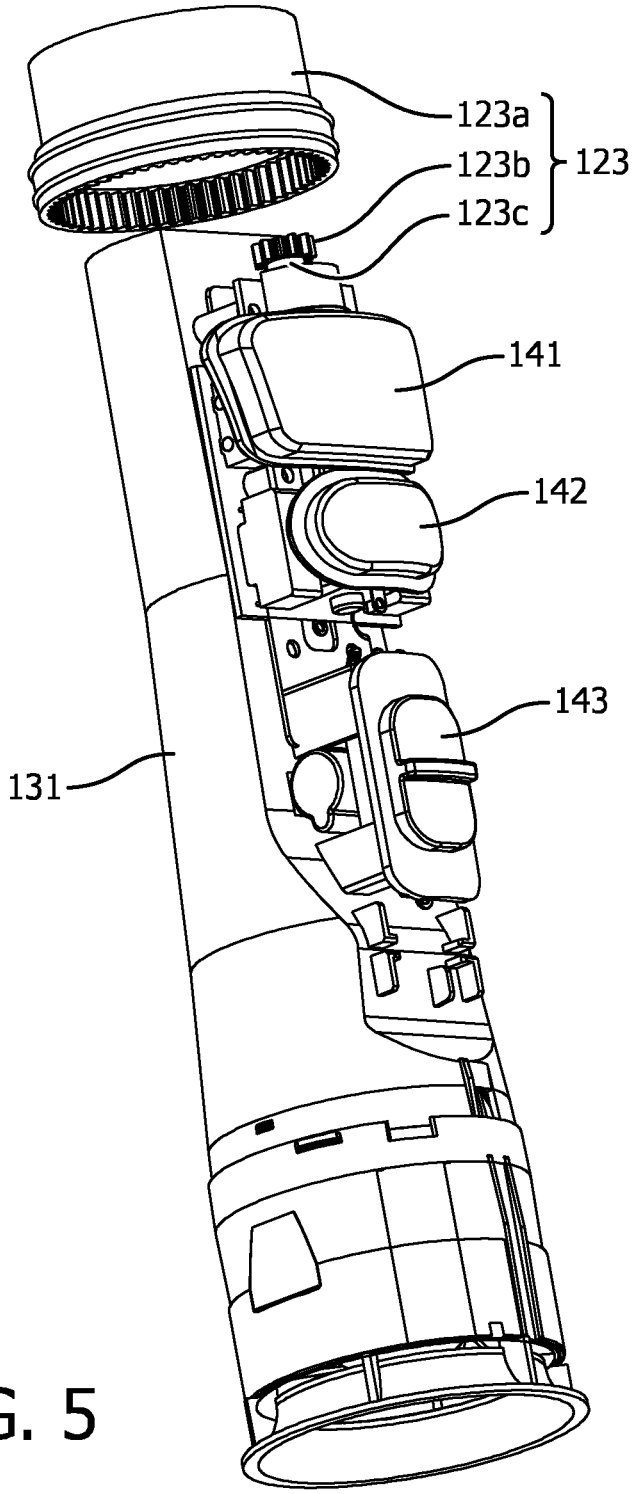
FIG. 5 is another partially exploded view of the hair styling device shown in FIG. 1.

Referring to FIG. 5, in some embodiments, for example in this embodiment, the drive assembly 123 includes a rotatable ring 123*a* provided with an inner toothed surface, a gear 123*b* engaging the inner toothed surface, and a first motor 123*c* provided for driving the gear 123*b*. The rotatable cylindrical shell 122 is installed on the rotatable ring 123*a*, and the gear 123*b* is connected with the first motor 123*c* and is driven by the first motor 123*c*.

Figure 6:
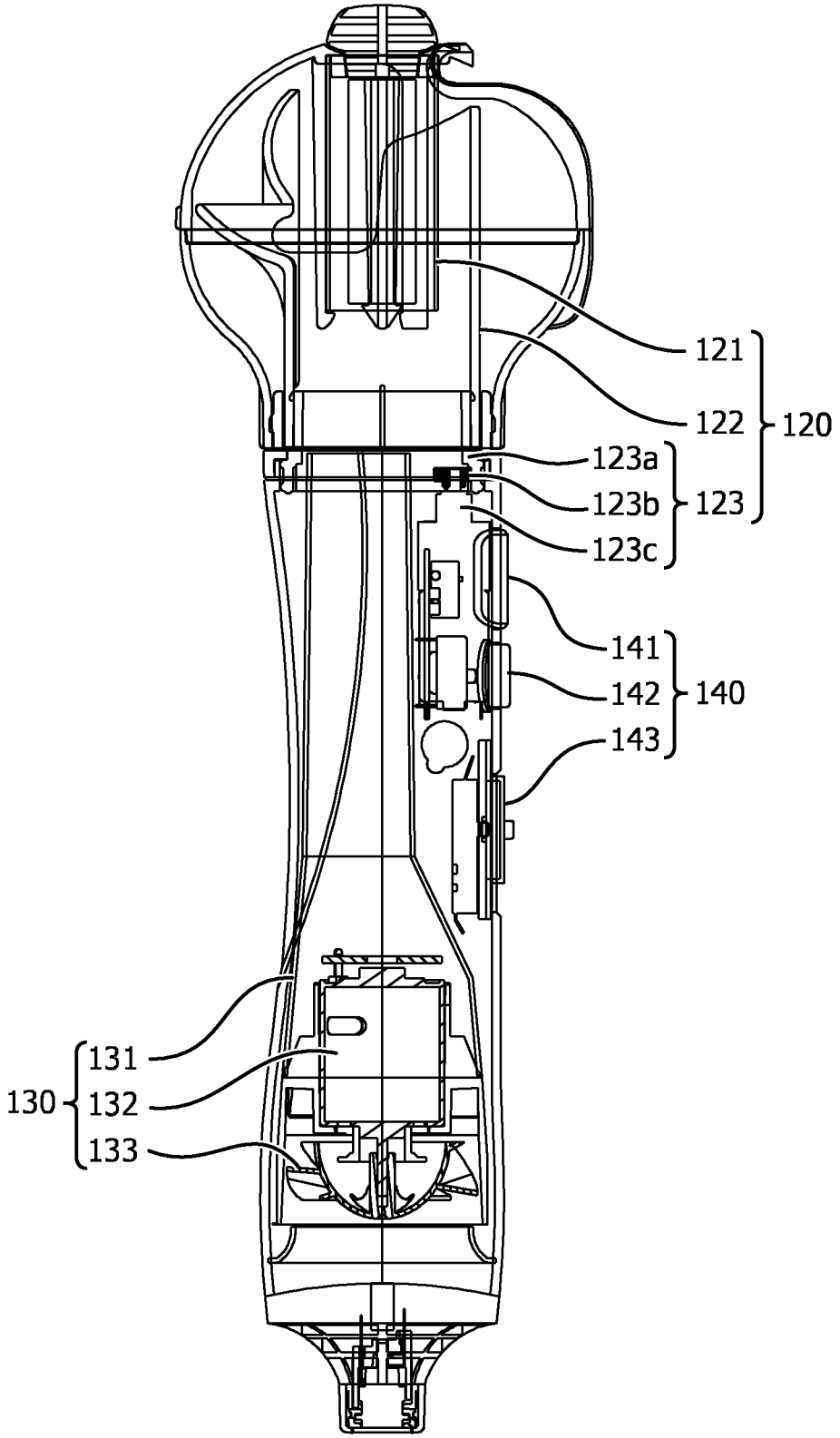
FIG. 6 illustrates an internal structure of the hair styling device according to the first embodiment of the present invention.

Referring to FIG. 5 and FIG. 6, in this embodiment, the wind supply assembly 130 is disposed inside the housing 111 for supplying cool wind and hot wind to the hair in the top casing 112. The wind supply assembly 130 includes a wind channel 131, a heating element (not shown) disposed inside the wind channel 131, fan blades 133 disposed at a lower end of the wind channel 131 and a second motor 132 provided for driving the fan blades 133. The wind channel has an upper end facing towards a lower end of the rotatable cylindrical shell 122 directly. The fan blades 133 face directly towards the air inlet 114 formed at the bottom of the handle 111. During operation of the second motor 132, the fan blades 133 can be driven to suck outside air into the wind channel 131 and in turn the air will be transmitted to the rotatable cylindrical shell 122 via the wind channel 131. At this stage, if the heating element is in operation, it will produce hot wind; otherwise it will produce natural wind (cool wind).

Referring to FIG. 5 and FIG. 6, in this embodiment, the control assembly 140 is connected with the drive assembly 120 and the wind supply assembly 130 for controlling an operating state of the hair styling device 10. In some embodiments, for example in this embodiment, the control assembly 140 includes a number of control buttons, all of which are exposed on the surface of the handle 111. The control buttons include a left-hand/right-hand rotation button 141, a cool wind button 142 and a wind speed/switch button 143. By means of left-hand/right-hand rotation button 141, the direction of rotation of the axis of the first motor 123*c* can be controlled, thereby controlling the direction of rotation of the rotatable cylindrical shell 122; by pressing the cool wind button 142, the heating element of wind supply assembly 130 can be controlled to be inoperative, thereby causing natural wind to be supplied (if the cool wind button 142 is not pressed, hot wind is a default choice); and by controlling the wind speed/switch button 143, the hair styling device 10 can be powered on or off and the wind speed can be regulated. Understandably, the control assembly 140 further includes a control circuit to control the whole hair styling device 10. All of the first motor 123*c*, the second motor 132, the heating element and the control buttons are connected with the control circuit, and by means of the control circuit, the control buttons control the first motor 123*c*, the second motor 132 and the heating element. Both the implementation and the working principle of the control circuit are well known to a person skilled in the art, and it does not need to be repeated here.

Referring to FIG. 2 and FIG. 3, in some embodiments, such as this embodiment, the hair styling device further includes a hair care assembly 150 which includes a holder 151 installed in the top casing 112 and a water absorbent element 152 fixed on the holder 151 and disposed inside the heat-conducting cylindrical shell 121 by passing through a through-hole 117 formed at the top of the top casing 112. In this preferable embodiment, the holder 151 includes a head part 151*a* and a spindle part 151*b* connected with the head part 151*a*. The spindle part 151*b* includes a projecting taper 151*c* formed at a tail end thereof. The spindle part 151*b* passes through the water absorbent element 152, so that the water absorbent element 152 is fixed on the spindle part 151*b* by means of the projecting taper 151*c*. The water absorbent element 152 could be made of sponge or other materials with high water-absorbing capacity. Before being installed into the heat-conducting cylindrical shell 121, the water absorbent element 152 could absorb water, essential oils or other liquid for hair care.

Figure 7:
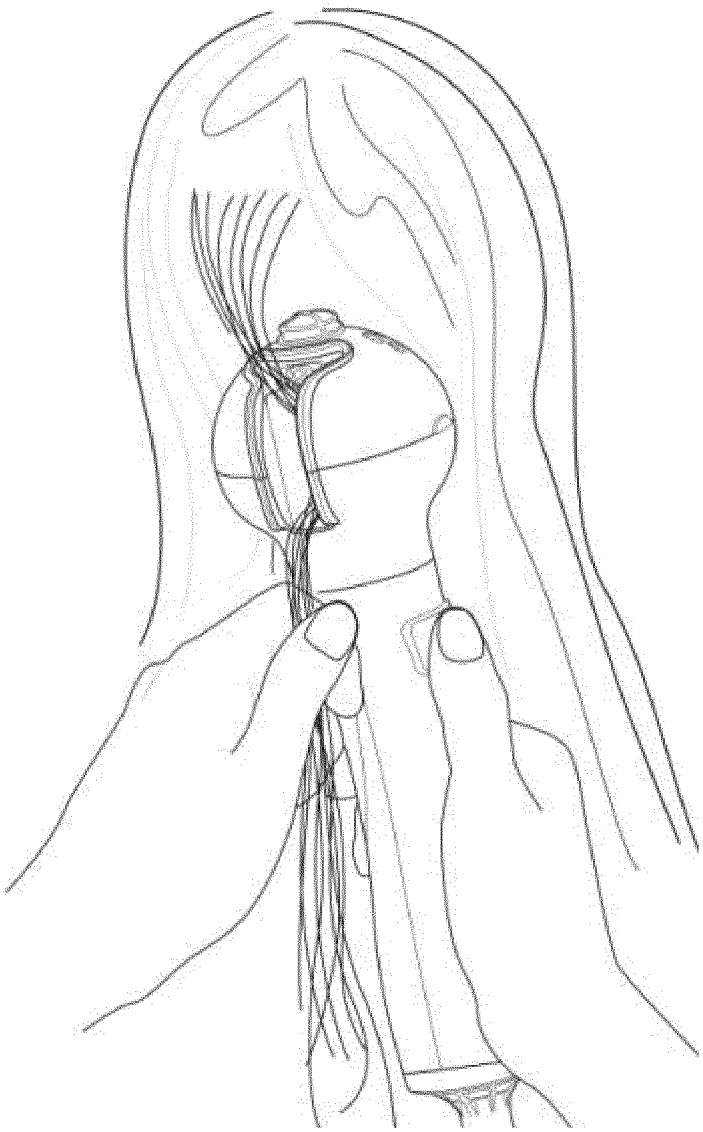
FIG. 7 illustrates the hair styling device, in operation, according to the first embodiment of the present invention.

Referring to FIG. 7 and combining FIG. 1 and FIG. 6, when curling hair by using the hair styling device according to the present invention, it suffices to put a clump of hair, at the location of the hair roots, into the hair inlet 113 and then press the left-hand or right-hand rotation button. Driven by the drive assembly 123, the rotatable cylindrical shell 122 will rotate in a way that has been chosen by the user (left-hand rotation or right-hand rotation). During the rotation, the hair in the hair inlet 113 will be caught by the hooked structures 122*c* or the hooked structures 122*d* and then the hair will enter into the space between the rotatable cylindrical shell 122 and the heat-conducting cylindrical shell 121 via the corresponding upward notches 122*a* or 122*b* and finally it will be wound around the heat-conducting cylindrical shell 121. The hair wound around the heat-conducting cylindrical shell 121 will be shaped by means of the hot wind supplied by the wind supply assembly 130; and during this process, the water or essential oils in the water absorbent element 152 of the hair care assembly 150 will be heated and evaporate and finally penetrate into the hair wound around the heat-conducting cylindrical shell 121, thereby achieving good hair care.

FIG. 8 to FIG. 14 illustrate a hair styling device according to a second embodiment of the present invention. Referring to FIG. 8 to FIG. 14, in this embodiment, the hair styling device 20 includes a housing 210, a curling assembly 220, a wind supply assembly 230 and a control assembly 240. The hair styling device 20 of this embodiment is provided without a hair care assembly. According to this embodiment, both the wind supply assembly 230 and the control assembly 240 have a similar structure to that of the first embodiment, thus it does not need to be repeated here. The main improvements of this embodiment are the top casing 212 and the curling assembly 220, both of which will be described in detail hereinbelow.

Figure 8:
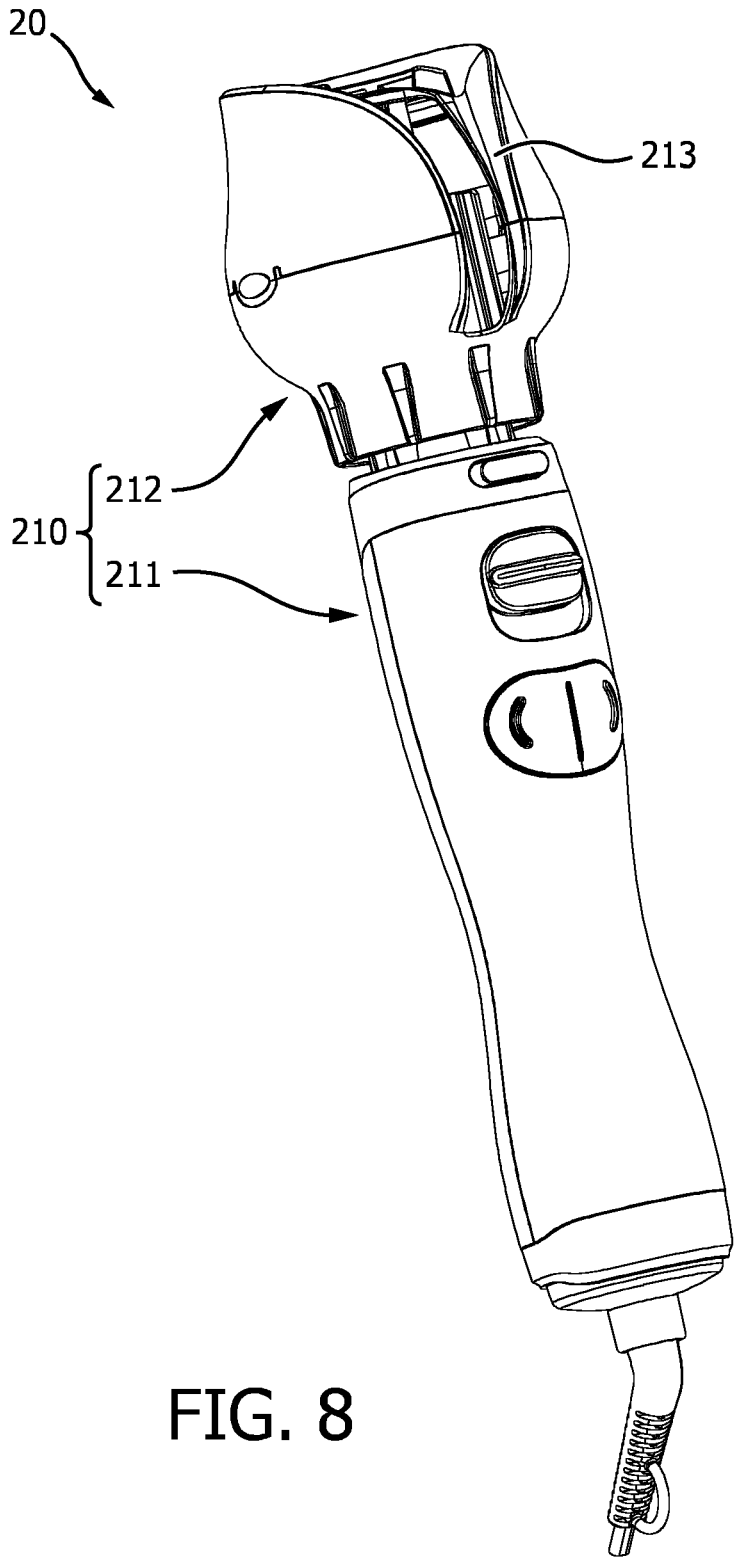
FIG. 8 is a perspective view of a hair styling device according to a second embodiment of the present invention.
Figure 9:
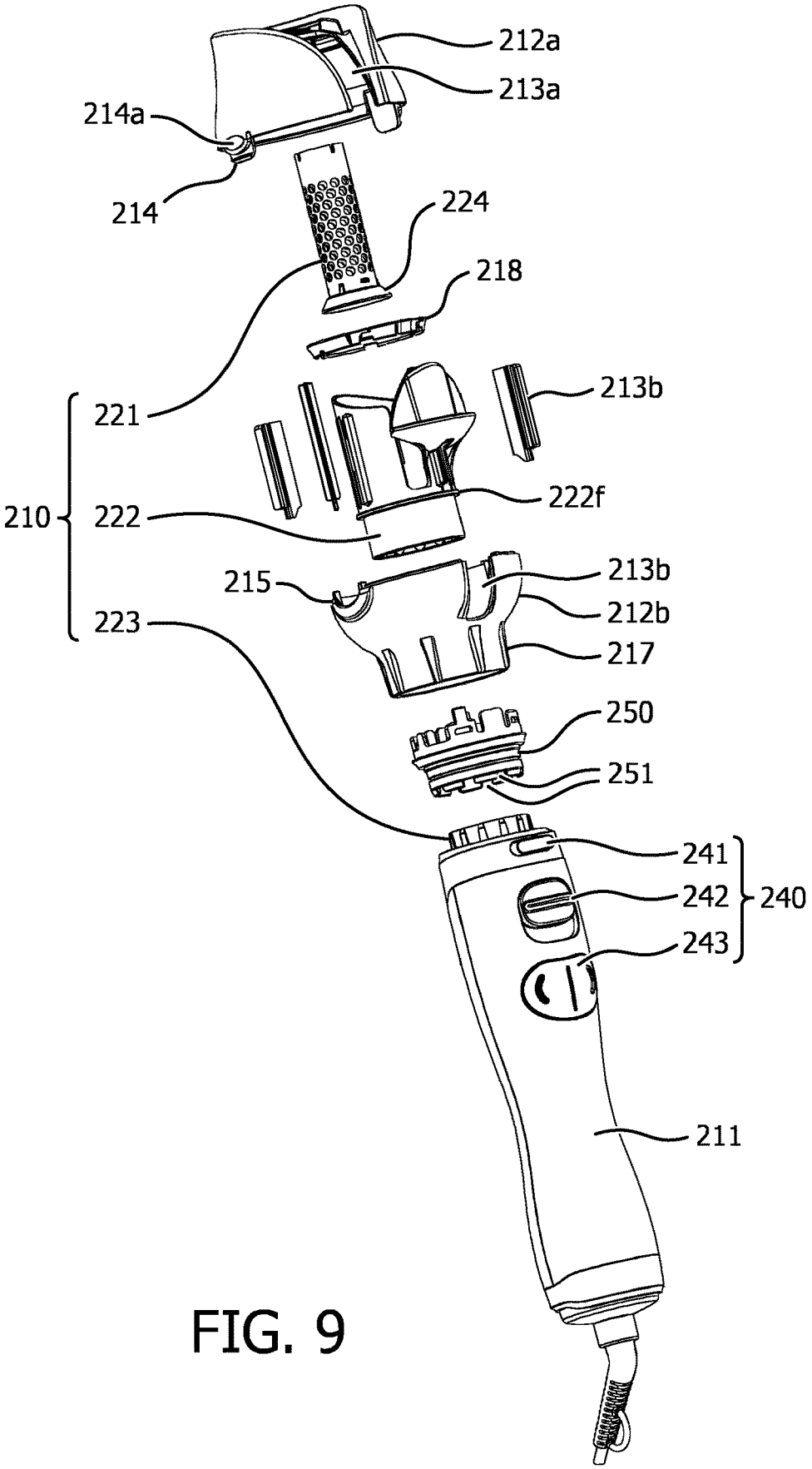
FIG. 9 is an exploded view of the hair styling device shown in FIG. 8.
Figure 10:
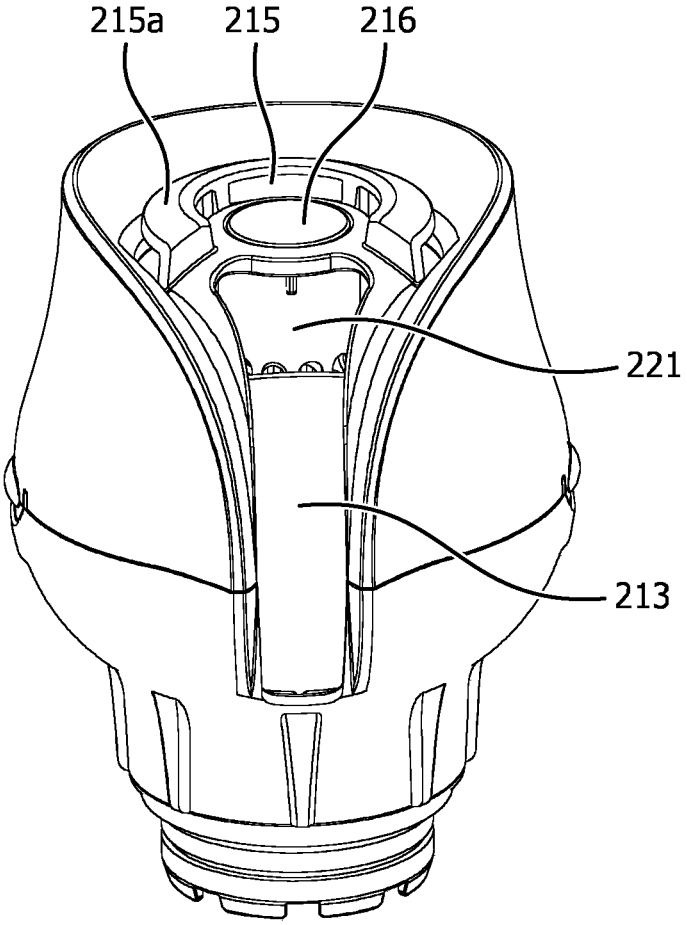
FIG. 10 is a partially exploded view of the hair styling device shown in FIG. 8.

Referring to FIG. 8 to FIG. 10, in this embodiment, the top casing 212 has a general globular external profile and the top casing 212 is made of thermal insulation material; or the inner wall of the top casing 212 is covered by a heat insulating layer made of thermal insulation material. In this specific embodiment, the top casing 212 includes an upper body 212*a* and a lower body 212*b*, which are assembled together. The upper body 212*a* has a first notch 213*a* formed on a side surface of the upper body 212*a* and extending to a top surface of the upper body 212*a*; and the lower body 212*b* has a second notch 213*b* formed on a side surface thereof. When the upper body 212*a* and the lower body 212*b* are assembled together, the first notch 213*a* and the second notch 213*b* together form a long and narrow hair inlet 213.

In this preferable embodiment, at least a locking element 214 is provided at a bottom edge of the upper body 212*a* and at least a corresponding groove 215 is provided at a top edge of the lower body 212*b*. The upper body 212*a* and the lower body 212*b* are assembled together by cooperation of the locking element 214 and the groove 215. A release button 214*a* is disposed on an outer surface of the locking element 214*a*. When pressing the release button 214*a*, the locking element 214 is capable of being released from the groove 215. Preferably, the release button 214*a* is made of thermal insulation material.

In this embodiment, a circular connecting element 250 is provided for connecting the upper body 212*b* and the handle 211. The top of the circular connecting element 250 is installed in the bottom of the lower body 212*b*. There are a number of locating notches 251 provided uniformly at the bottom of the circular connecting element 250 and a number of corresponding locating protrusions (not shown) provided at the top of the handle 211. By cooperation of the locating notches 251 and the locating protrusions, a number of installation locations are provided between the top casing 212 and the handle 211. On the basis of such a design, the user can choose any one of the installation locations according to the actual need so as to change the relative location between the hair inlet 213 of the top casing 212 and the control buttons on the handle 211 for ease of use. Preferably, in order to easily and quickly align the locating notches 251 with corresponding locating protrusions, one of the locating protrusions is disposed at a position aligning with the cool wind button 241; and a number of triangular bumps 217, each of which corresponds to one of the locating notches 251, are provided on an outer surface of the bottom of the lower body 212*b*. When installing the top casing 212, by aligning each one of the bumps 217 with the cool wind button 241, the top casing 212 will be installed onto the handle 211 accurately and quickly.

Referring to FIG. 9 and FIG. 10, the curling assembly 220 of this embodiment includes a heat-conducting cylindrical shell 221 fixed inside the top casing 212 and provided with through-holes formed therein, a rotatable cylindrical shell 222 surrounding the heat-conducting cylindrical shell 221 and a drive assembly 223 connected with the rotatable cylindrical shell 222. The drive assembly 223 is used for driving the rotatable cylindrical shell 222 to rotate around the heat-conducting cylindrical shell 221 so as to make the hair passing through the hair inlet 213 be wound around the heat-conducting cylindrical shell 221.

Figure 13:
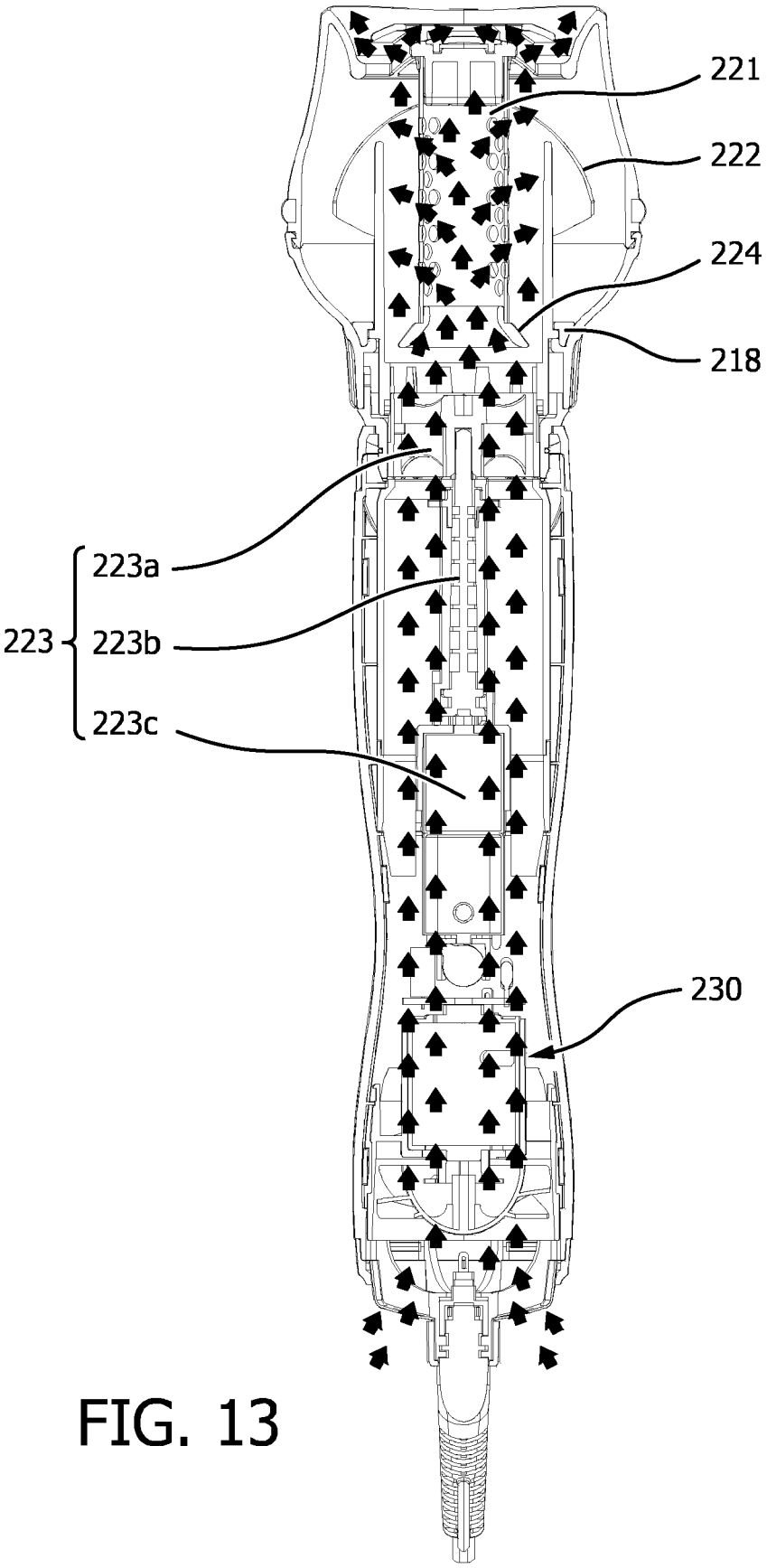
FIG. 13 illustrates an internal structure of the hair styling device and shows the flow directions of the hot wind/cool wind according to the second embodiment of the present invention.
Figure 14:
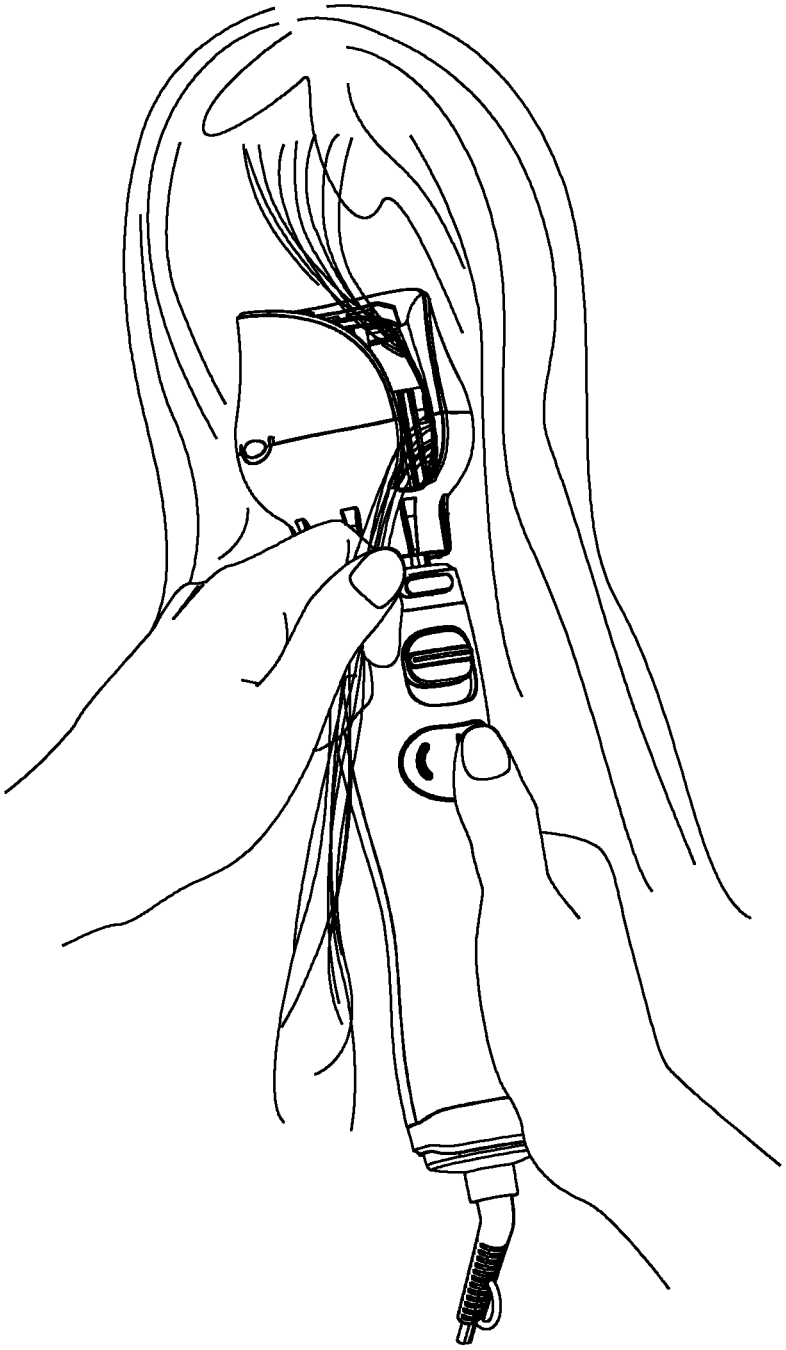
FIG. 14 illustrates the hair styling device, in operation, according to the second embodiment of the present invention.

Preferably, in this embodiment, the top of the heat-conducting cylindrical shell 221 is fixed directly on a top central area 216 of the upper body 212*a*. The heat-conducting cylindrical shell 221 is provided with an air guiding element 224 disposed at a bottom thereof. The air guiding element 224 includes a top opening and a bottom opening with a diameter bigger than that of the top opening. The top opening is fixed at the bottom of the heat-conducting cylindrical shell 211 and the bottom opening faces directly towards an outlet of a wind channel of the handle 211 (as shown in FIG. 13 and FIG. 14). Due to the air guiding element 224, almost all of the hot wind/cool wind will be guided into the heat-conducting cylindrical shell 211.

Figure 11:
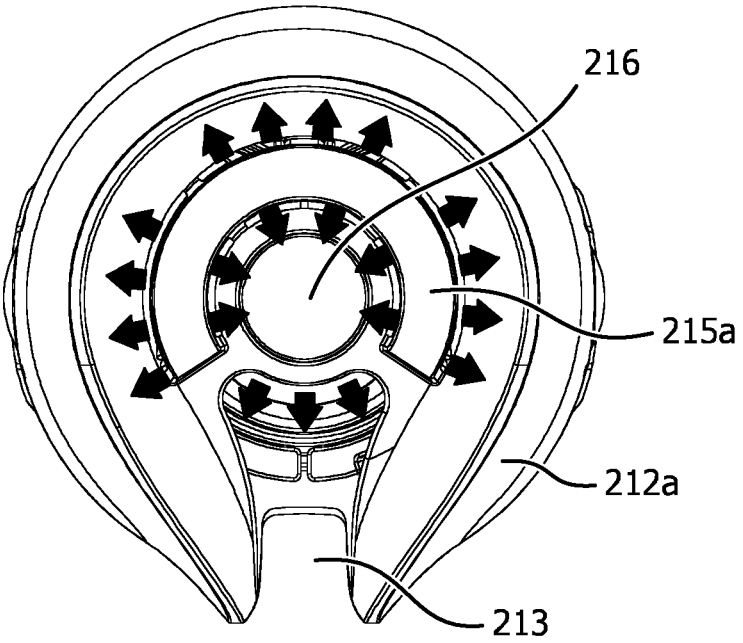
FIG. 11 illustrates an air outlet of the hair styling device shown in FIG. 8.
Figure 12:
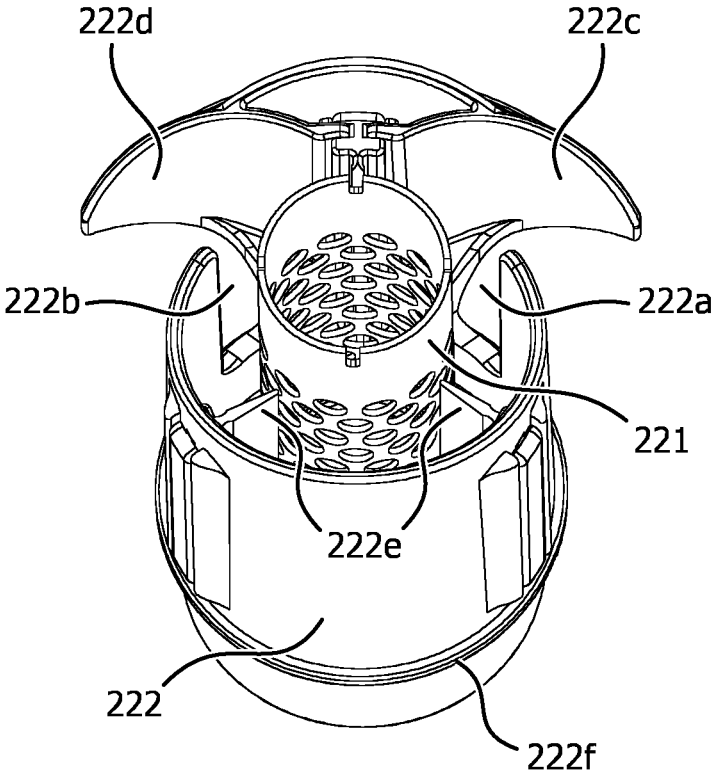
FIG. 12 illustrates a rotatable cylindrical shell and an inner cylindrical shell of the hair styling device shown in FIG. 8.

Referring to FIG. 10 and FIG. 11, in this embodiment, the air outlet 215 surrounds the top central area 216. The air outlet 215 is a cambered hole; and a wind shield 215*a* is provided above the air outlet 215 for guiding the hot wind/cool wind towards the inside edge and outside edge of the wind shield 215*a*, respectively, as shown in FIG. 12. The wind shield 215*a* is provided for preventing the hot wind/ cool wind blowing directly into the face of an operator. It should be noted that the air outlet 215 could be composed of a number of round holes which are distributed around the top central area 216 of the upper body 212*a* and corresponding round wind shields are provided above the round holes for guiding the hot wind/cool wind.

Referring to FIG. 12, in this embodiment, the rotatable cylindrical shell 222 has a similar structure to that of the rotatable cylindrical shell 122 of the first embodiment. For example, the rotatable cylindrical shell 222 has two upward notches 222*a*, 222*b* and two hooked structures 222*c*, 222*d* formed thereon. The two hooked structures 222*c*, 222*d* are formed by an integrated structure and they bend towards corresponding upward notches 222*a*, 222*b*, respectively, in opposite direction. And in this preferable embodiment, there are three elastic strips 222*e* made of heat resisting elastic material, such as silicone, disposed on an inner wall of the rotatable cylindrical shell 222 along a longitudinal direction thereof and they extend towards the heat-conducting cylindrical shell 221 for applying pressure on the hair wound around the heat-conducting cylindrical shell 221. In this preferable embodiment, the elastic strips 222*e* are distributed uniformly in the rotatable cylindrical shell 222. It should be noted that the number of elastic strips 222*e* can be changed according to actual need, but not limited to three, for example, it could be one or two.

Referring to FIG. 12 and FIG. 9, in this embodiment, a circular flange 222*f* is formed on the outside surface of the lower portion of the rotatable cylindrical shell 222. The lower portion of the rotatable cylindrical shell 222 is installed at the bottom of the lower body 212*b* and is capable of rotating relative to the top casing 212 by means of a ring part 218 cooperating with the circular flange 222*f*. After the lower body 212*b* is installed onto the handle 211, the rotatable cylindrical shell 222 is installed onto the rotatable ring 223*a* of the drive assembly 223 and is capable of rotating relative to the top casing 212 during operation of the drive assembly 223. Referring to FIG. 13, the drive assembly 223 according to this embodiment includes said rotatable ring 223*a*, a shaft 223*b*, and a motor 223*c*. The rotatable cylindrical shell 222 is installed on and driven by the rotatable ring 223*a*. The rotatable ring 223*a* is connected to the motor 223*c* via the shaft 223*b*. The motor 223*c* drives the rotatable ring 223*a* through the shaft 223*b*, and the rotatable ring 223*a* further drives the rotatable cylindrical shell 222. The motor 223*c* is connected with and controlled by the control assembly, similar to the first embodiment.

Referring to FIG. 8 to FIG. 14, when hair is to be curled by using the hair styling device 20 according to the second embodiment, firstly, turn on the hair styling device 20 by pressing the wind speed/switch button 242; secondly, put a clump of hair, at the location of the hair roots, into the hair inlet 213; and finally press the left-hand or right-hand rotation button 243 according to actual need. At this stage, the rotatable cylindrical shell 222 will rotate in a way that has been chosen by the user (left-hand rotation or right-hand rotation) during operation of the drive assembly 223. During the rotation of the rotatable cylindrical shell 222, the hair in the hair inlet 113 will be caught by the hooked structures 222*c* or the hooked structures 222*d* and then the hair will enter into the space between the rotatable cylindrical shell 222 and the heat-conducting cylindrical shell 221 via the corresponding upward notches 222*a* or 222*b*, and finally the hair will be wound around the heat-conducting cylindrical shell 221. As shown in FIG. 13, the hot wind supplied by the wind supply assembly enters into the heat-conducting cylindrical shell 221 under the guidance of the air guiding element 224 and then enters into the space between the heat-conducting cylindrical shell 221 and the rotatable cylindrical shell 222 via the through-holes in the heat-conducting cylindrical shell 221, and thereby the hair wound around the heat-conducting cylindrical shell 221 will be shaped by means of the hot wind supplied by the wind supply assembly 230. Additionally, by means of the heat conduction of the heat-conducting cylindrical shell 221, the effect on curling will be further improved.

In conclusion, the present invention has a number of advantages, such as: when curling hair by using the hair styling device of the present invention, the hair could be wound around the heat-conducting cylindrical shell and at this stage hot wind will be supplied to the hair wound around the heat-conducting cylindrical shell, so that the hair will be heated evenly and then shaped finally. As a result, it causes less damage to the hair and it looks more natural. Additionally, because the heat-conducting cylindrical shell is disposed inside the housing, the skin of users will not be burned, thus it has better safety characteristics.

While the invention has been described in connection with what are presently considered to be the most practical and preferred embodiments, it is to be understood that the invention is not to be limited to the disclosed embodiments but, on the contrary, is intended to cover various modifications and equivalent arrangements included within the scope of the invention.

The invention claimed is:

1. A hair styling device, comprising:

an inner cylindrical shell provided with through-holes;

a rotatable cylindrical shell surrounding the inner cylindrical shell; wherein:

the rotatable cylindrical shell has at least an upward notch formed thereon and at least a hooked structure formed at a side of the upward notch and bending towards the upward notch;

a drive assembly for driving the rotatable cylindrical shell to rotate around the inner cylindrical shell, hair being caught by the hooked structure and wound around the inner cylindrical shell; and a wind supply assembly for supplying hot air to any hair wound around the inner cylindrical shell through the through-holes.

2. The hair styling device according to claim 1, wherein the inner cylindrical shell is fixed inside a top casing, the top casing having a hair inlet formed thereon and an air outlet formed at a top thereof.

3. The hair styling device according to claim 2, wherein a wind shield is provided above the air outlet for guiding the hot air toward two sides of the wind shield.

4. The hair styling device according to claim 3, wherein the air outlet is a cambered hole; and the wind shield is a corresponding cambered plate for guiding the hot air toward an inside edge and an outside edge of the cambered plate.

5. The hair styling device according to claim 2, further comprising a handle connected to the top casing, an air inlet formed at a bottom of the handle.

6. The hair styling device according to claim 5, wherein an air guiding element is disposed at a bottom of the inner cylindrical shell, the air guiding element comprising a top opening fixed at the bottom of the inner cylindrical shell and a bottom opening with a diameter bigger than that of the top opening and facing towards an outlet of a wind channel of the handle directly.

7. The hair styling device according to claim 6, wherein at least an elastic strip made of heat resisting elastic material is disposed on an inner wall of the rotatable cylindrical shell along a longitudinal direction thereof and extends towards the inner cylindrical shell for applying pressure onto the hair wound around the inner cylindrical shell.

8. The hair styling device according to claim 2, wherein a circular flange is formed on an outside surface of a lower portion of the rotatable cylindrical shell; and the lower portion of the rotatable cylindrical shell is installed at the bottom of the top casing and is rotatable relative to the top casing by means of a ring part cooperated with the circular flange.

9. The hair styling device according to claim 2, wherein the top casing comprises an upper body and a lower body and at least a locking element is provided at a bottom edge of the upper body and at least a corresponding groove is provided at a top edge of the lower body, the upper body and the lower body being assembled together by means of cooperation of the locking element and the groove.

10. The hair styling device according to claim 9, wherein the upper body has a first notch formed on a side surface of the upper body and extending to a top surface of the upper body; the lower body has a second notch formed on a side surface thereof; and when the upper body and the lower body are assembled together, the first notch and the second notch form a long and narrow hair inlet together.

11. The hair styling device according to claim 10, wherein a circular connecting element is provided for connecting the top casing and the handle; a top of the circular connecting element is installed onto the bottom of the lower body; a number of locating notches are provided at a bottom of the circular connecting element uniformly and a number of corresponding locating protrusions are provided at the top of the handle; by means of cooperation of the locating notches and the locating protrusions, there are a number of installation locations provided between the top casing and the handle.

12. The hair styling device according to claim 11, wherein a number of bumps, each of which is corresponding to one of the locating notches, are provided on outer surface of the bottom of the lower body.

13. The hair styling device according to claim 2, further comprising a hair care assembly which comprises a holder installed in the top casing and a water absorbent element fixed on the holder and disposed inside the inner cylindrical shell by passing through a through hole formed at the top of the top casing.

14. The hair styling device according to claim 1, wherein the drive assembly comprises a rotatable ring provided with an inner tooth surface, a gear engaging with the inner tooth surface of the rotatable ring and a first motor provided for driving the gear, the rotatable cylindrical shell being installed onto the rotatable ring, and the first motor being connected with and controlled by a control assembly.

15. The hair styling device according to claim 1, wherein the drive assembly comprises a rotatable ring, a shaft, and a motor, the rotatable ring connected to the motor via the shaft and driven by the motor, the rotatable cylindrical shell being installed onto the rotatable ring, and the motor being connected with and controlled by a control assembly.

16. The hair styling device according to claim 1, wherein the wind supply assembly comprises a wind channel, a heating element disposed inside the wind channel, fan blades disposed at a lower end of the wind channel and a second motor provided for driving the fan blades.

17. The hair styling device according to claim 1, wherein the inner cylindrical shell is a heat-conducting cylindrical shell comprising a tubular structure made of metal material.

18. A hair styling device, comprising:

an inner cylindrical shell provided with through-holes;

a rotatable cylindrical shell surrounding the inner cylindrical shell; wherein:

the rotatable cylindrical shell has a hooked structure;

a drive assembly for driving the rotatable cylindrical shell to rotate around the inner cylindrical shell, wherein hair being caught by the hooked structure is wound around the inner cylindrical shell; and a wind supply assembly for supplying hot air to the hair wound around the inner cylindrical shell through the through-holes.

19. The hair styling device of claim 18, wherein the inner cylindrical shell is a heat-conducting cylindrical shell comprising a tubular structure made of metal material.

20. The hair styling device of claim 18, wherein the inner cylindrical shell is fixed inside a top casing, the top casing having a hair inlet formed thereon and an air outlet formed at a top thereof.

* * * * *